US009158271B2

(12) United States Patent
Nishiyama et al.

(10) Patent No.: US 9,158,271 B2
(45) Date of Patent: Oct. 13, 2015

(54) PHOTOSENSITIVE MEMBER CARTRIDGE

(71) Applicants: Hideshi Nishiyama, Owariasahi (JP); Naoya Kamimura, Ichinomiya (JP)

(72) Inventors: Hideshi Nishiyama, Owariasahi (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/090,558

(22) Filed: Nov. 26, 2013

(65) Prior Publication Data

US 2014/0147159 A1 May 29, 2014

(30) Foreign Application Priority Data

Nov. 27, 2012 (JP) ..... 2012-258898

(51) Int. Cl.
*G03G 21/18* (2006.01)

(52) U.S. Cl.
CPC .... *G03G 21/1867* (2013.01); *G03G 2215/0141* (2013.01)

(58) Field of Classification Search
CPC ..... G03G 15/80; G03G 21/1652; G03G 21/1828; G03G 21/1867; G03G 21/1871; G03G 2221/166
USPC ..... 399/90, 111
See application file for complete search history.

(56) References Cited

U.S. PATENT DOCUMENTS

| | | | | |
|---|---|---|---|---|
| 8,165,491 | B2 | 4/2012 | Kamimura | |
| 2009/0169234 | A1 | 7/2009 | Kamimura | |
| 2011/0206407 | A1 * | 8/2011 | Mushika et al. | 399/90 |
| 2013/0051834 | A1 * | 2/2013 | Kamimura | 399/90 |
| 2013/0058675 | A1 * | 3/2013 | Anan et al. | 399/90 |

FOREIGN PATENT DOCUMENTS

JP 2009-162911 A 7/2009

* cited by examiner

*Primary Examiner* — Sophia S Chen
(74) *Attorney, Agent, or Firm* — Banner & Witcoff, Ltd.

(57) ABSTRACT

A photosensitive member cartridge includes first and second side walls which rotatably support end portions of the photosensitive member in an axial direction of the photosensitive member, a rotating body disposed between the first side wall and the second side wall to face the photosensitive member, and a cartridge electrode which extends in the axial direction and disposed on the first side wall to be movable in the axial direction, and contacts the rotating body to supply electric power to the rotating body. The cartridge electrode includes a contact portion which contacts an end surface of the rotating body in the axial direction. The first side wall includes an abutting portion which abuts on the end surface of the rotating body. The cartridge electrode is configured such that the first contact portion is movable further than the abutting portion in the axial direction.

13 Claims, 9 Drawing Sheets

PHOTOSENSITIVE MEMBER CARTRIDGE

CROSS-REFERENCE TO RELATED APPLICATION

This application is based on Japanese Patent Application No. 2012-258898, filed on Nov. 27, 2012, the entire subject matter of which is incorporated herein by reference.

TECHNICAL FIELD

Aspects of the present invention relate to a photosensitive member cartridge to be mounted in an image forming apparatus employing an electro-photographic method.

BACKGROUND

As an image forming apparatus employing an electro-photographic method, there has been known an image forming apparatus which includes a photosensitive member cartridge having a photosensitive member, and a developing cartridge for accommodating developer.

As an example of a photosensitive member cartridge to be mounted in that image forming apparatus, there has been known a process cartridge which includes a photosensitive drum, and a cleaning roller for electrically removing foreign materials such as residual toner or sheet powders attached on the circumferential surface of the photosensitive drum (see, for example, JP-A-2009-162911).

In this process cartridge, a cleaning roller electrode is provided for supplying a bias from a main body casing to the cleaning roller.

SUMMARY

In the above-described photosensitive member cartridge described in JP-A-2009-162911, it may be considered to form electrodes, such as the cleaning roller electrode, using a conductive resin in view of ease of molding.

In this case, for example, when the photosensitive member cartridge were dropped by mistake while the cleaning roller electrode and the cleaning roller is in contact with each other, dropping load on the cleaning roller might act on the cleaning roller electrode, resulting in breakage of the cleaning roller electrode.

Accordingly, an aspect of the present invention provides a photosensitive member cartridge capable of suppressing a cartridge electrode from being broken, for example, when the photosensitive member cartridge is dropped by mistake.

According to an illustrative embodiment of the present invention, there is provided a photosensitive member cartridge including: a photosensitive member; a first side wall configured to rotatably support one end portion of the photosensitive member at one side in an axial direction of the photosensitive member; a second side wall configured to rotatably support the other end portion of the photosensitive member at the other side in the axial direction of the photosensitive member; a rotating body disposed between the first side wall and the second side wall to face the photosensitive member from a direction orthogonal to the axial direction; and a cartridge electrode extending in the axial direction and disposed on the first side wall to be movable in the axial direction, and configured to contact the rotating body to supply electric power input from an external part to the rotating body.

The cartridge electrode includes a first contact portion configured to contact an end surface of the rotating body at the one side in the axial direction, and a second contact portion disposed at an opposite side to the rotating body with respect to the first side wall in the axial direction, and configured to contact an electrode of the external part.

The first side wall includes an opening portion penetrating in the axial direction, and in which the cartridge electrode is disposed, and an abutting portion disposed to overlap the opening portion in a direction orthogonal to the axial direction, and configured to abut on the end surface of the rotating body.

The cartridge electrode is configured such that the first contact portion moves to the one side in the axial direction further than the abutting portion.

According to the above configuration, for example, when the photosensitive member cartridge is dropped by mistake, the rotating body abuts on the abutting portion of the first side wall while moving the cartridge electrode in the axial direction such that the first contact portion moves further outer side than the abutting portion in the axial direction.

Therefore, the first contact portion of the cartridge electrode can be separated from the rotating body while receiving the load of the rotating body by the abutting portion, and thus, the load of the rotating body can be prevented from acting on the cartridge electrode.

As a result, the cartridge electrode can be suppressed from being broken, for example, when the photosensitive member cartridge is dropped by mistake.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIGS. 3A and 3B are explanatory views for explaining the assembled state of a photosensitive drum and a drum cleaning roller with a base frame shown in FIG. 2, wherein FIG. 3A is a perspective view showing the drum cartridge as seen from the front upper side with a cover frame removed, and FIG. 3B is an explanatory view for explaining a cleaning roller bearing and drum bearings.

FIGS. 8A and 8B are explanatory views for explaining the contact state of the drum cleaning electrode and the roller shaft, together with FIG. 7, and show a state where a roller shaft contact portion is in contact with the roller shaft, wherein FIG. 8A is a cross-sectional view taken along a line A-A of FIG. 7, and FIG. 8B is a cross-sectional view taken along a line B-B of FIG. 7; and FIGS. 9A and 9B are explanatory views for explaining the contact state of the drum cleaning electrode and the roller shaft, together with FIG. 7, and show a state where the roller shaft contact portion is separate from the roller shaft, wherein FIG. 9A is a cross-sectional view taken along the line A-A of FIG. 7, and FIG. 9B is a cross-sectional view taken along the line B-B of FIG. 7.

DETAILED DESCRIPTION

1. Overall Configuration of Printer

Figure 1:
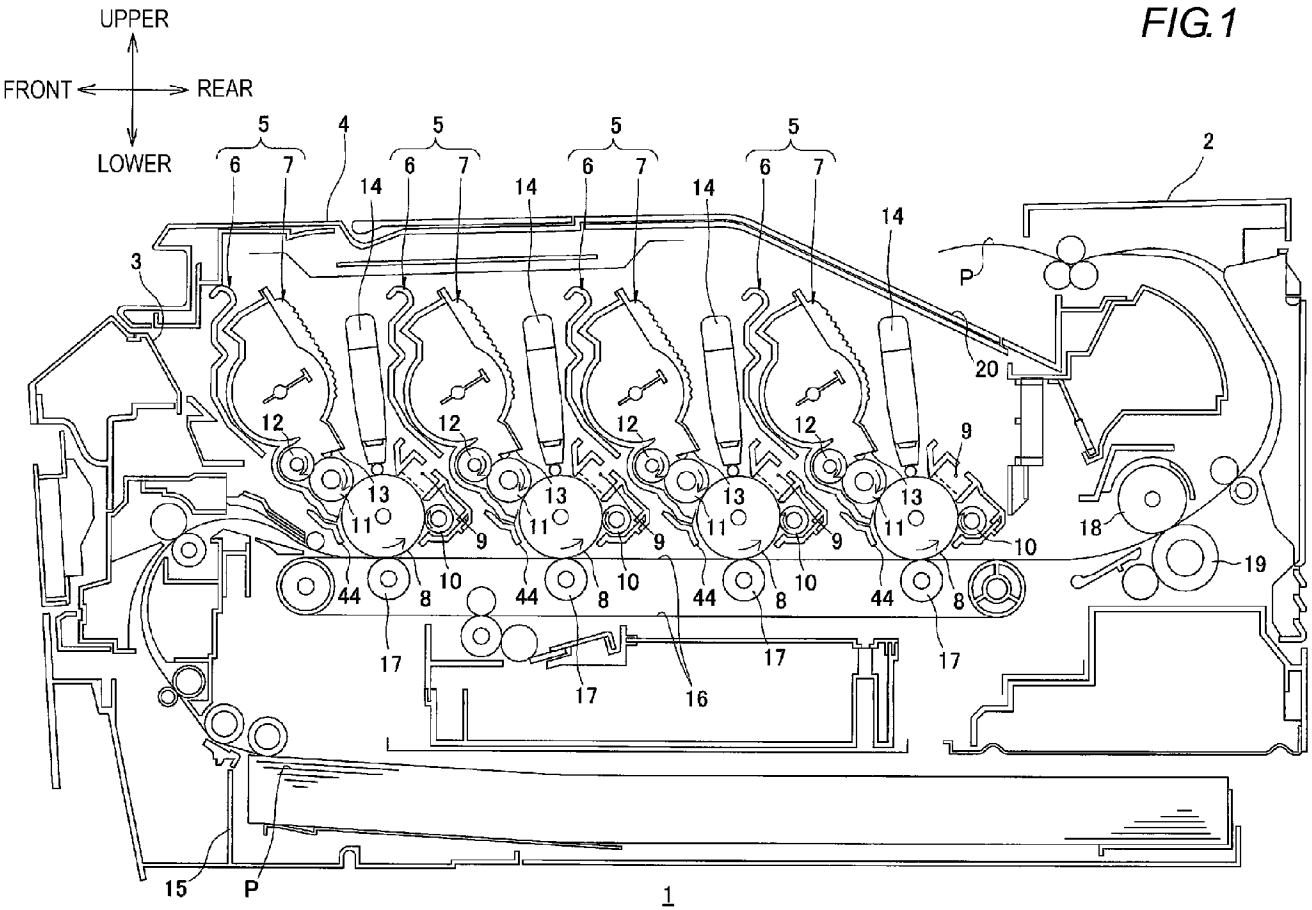
FIG. 1 is a view showing a central cross-section of a printer having a drum cartridge which is an example of a photosensitive member cartridge according to an illustrative embodiment of the present invention.

As shown in FIG. 1, a printer 1 is a tandem-type direct color printer which is horizontally installed.

In the following description, when directions of the printer 1 are stated, the upper side and lower side of the printer refer to a state where the printer 1 is horizontally installed. That is, the upper side of the drawing sheet of FIG. 1 is referred to as the upper side of the printer 1, and the lower side of the drawing sheet of FIG. 1 is referred to as the lower side of the printer 1. Further, the left side of the drawing sheet of FIG. 1 is referred to as the front side of the printer 1, and the right side of the drawing sheet of FIG. 1 is referred to as the rear side of the printer 1. Furthermore, the left side and right side of the printer 1 are based on the state of the printer as seen from the front side. That is, a direction toward a viewer of FIG. 1 is referred to as the right side of the printer, and a direction away from the viewer of FIG. 1 is referred to as the left side of the printer.

Also, a left-right direction is an example of a first direction, and a vertical direction is an example of a second direction, and a front-rear direction is an example of a third direction. Further, the right side is an example of one side of the first direction, and the left side is an example of the other side of the first direction. Furthermore, the upper side is an example of one side of the second direction, and the lower side is an example of the other side of the second direction. Moreover, the front side is an example of one side of the third direction, and the rear side is an example of the other side of the third direction.

The printer 1 includes a main body casing 2 (an example of an external part). The main body casing 2 is formed substantially in a box shape. An upper end portion of the main body casing 2 is proved with a top cover 4 to be rotatable about a rear end portion of the top cover 4 for opening and closing a main body opening 3. The printer 1 includes a plurality of process cartridges 5.

The plurality (four in this illustrative embodiment) of process cartridges 5 are removably mounted inside the main body casing 2 in parallel at an interval therebetween. The plurality of process cartridges 5 correspond to a plurality of colors, specifically, black, yellow, magenta, and cyan, respectively.

Each process cartridge 5 includes a drum cartridge 6 (an example of a photosensitive member cartridge), and a developing cartridge 7 which is removably mounted on the drum cartridge 6.

The drum cartridge 6 includes a photosensitive drum 8 (an example of a photosensitive member), a scorotron charger 9, and a drum cleaning roller 10 (an example of a rotating body).

The photosensitive drum 8 is provided at the rear lower end portion of the drum cartridge 6 to be rotatable counterclockwise as seen in a right side view. The photosensitive drum 8 is formed substantially in a cylindrical shape which is long in the left-right direction (an example of an axial direction).

The scorotron charger 9 is disposed at an interval from the rear upper side of the photosensitive drum 8 so as to face the rear upper side of the photosensitive drum 8.

The drum cleaning roller 10 is disposed to face the rear side of the photosensitive drum 8. That is, the front-rear direction of the printer 1 is an example of a facing direction in which the photosensitive drum 8 and the drum cleaning roller 10 face each other. The drum cleaning roller 10 is in contact with the photosensitive drum 8 from the rear side. The drum cleaning roller 10 is rotatable clockwise as seen in a right side view, following the rotation of the photosensitive drum 8.

The developing cartridge 7 includes a developing roller 11, and a supply roller 12.

The developing roller 11 is provided at the rear lower end portion of the developing cartridge 7 to be exposed to the rear lower side. The developing roller 11 is in contact with the photosensitive drum 8 from the front upper side. The developing roller 11 is rotatable clockwise as seen in a right side view.

The supply roller 12 is disposed at the front upper side of the developing roller 11, and is in contact with the developing roller 11 from the front upper side. The supply roller 12 is rotatable clockwise as seen in a right side view.

The developing cartridge 7 includes a layer-thickness regulating blade 13 which is in contact with the developing roller 11 from the upper side. A portion of the developing cartridge 7 above the developing roller 12 and the layer-thickness regulating blade 13 stores toner.

Then, if a print job is input to the printer 1, an image forming operation starts. The toner stored in the developing cartridges 7 is friction-charged between the supply rollers 12 and the developing rollers 11, and is carried on the surfaces of the developing rollers 11 as thin layers having a uniform thickness by the layer-thickness regulating blades 13, respectively.

The surfaces of the photosensitive drums 8 are uniformly charged by the scorotron chargers 9, and then are exposed based on image data by the LED units 14 disposed to face the upper sides of the photosensitive drums 8, respectively. Accordingly, electrostatic latent images based on the image data are formed on the surfaces of the photosensitive drums 8, respectively. Thereafter, the toner carried on the developing rollers 11 is supplied to the electrostatic latent images formed on the surfaces of the photosensitive drums 8, whereby toner images are carried on the surfaces of the photosensitive drums 8, respectively.

A sheet P stored in a sheet feeding tray 15 provided at the bottom of the main body casing 2 is conveyed along a U-turn path toward the rear upper side by various rollers, so that the sheet P is fed one by one into the respective gaps between the photosensitive drums 8 and a conveyor belt 16 at a predetermined timing. Then, the sheet P is conveyed from the front side toward the rear side through the gaps between respective photosensitive drums 8 and transfer rollers 17 by the conveyor belt 16. At this time, the toner images are transferred onto the sheet P, respectively.

When the sheet P passes through the gap between a heating roller 18 and a pressing roller 19, the sheet P is heated while being pressed, so that the toner image is thermally fixed on the sheet P.

Thereafter, the sheet P is conveyed to make a U-turn toward the front upper side, and is discharged onto a sheet discharge tray 20 provided at the top cover 4.

2. Drum Cartridge

Figure 2:
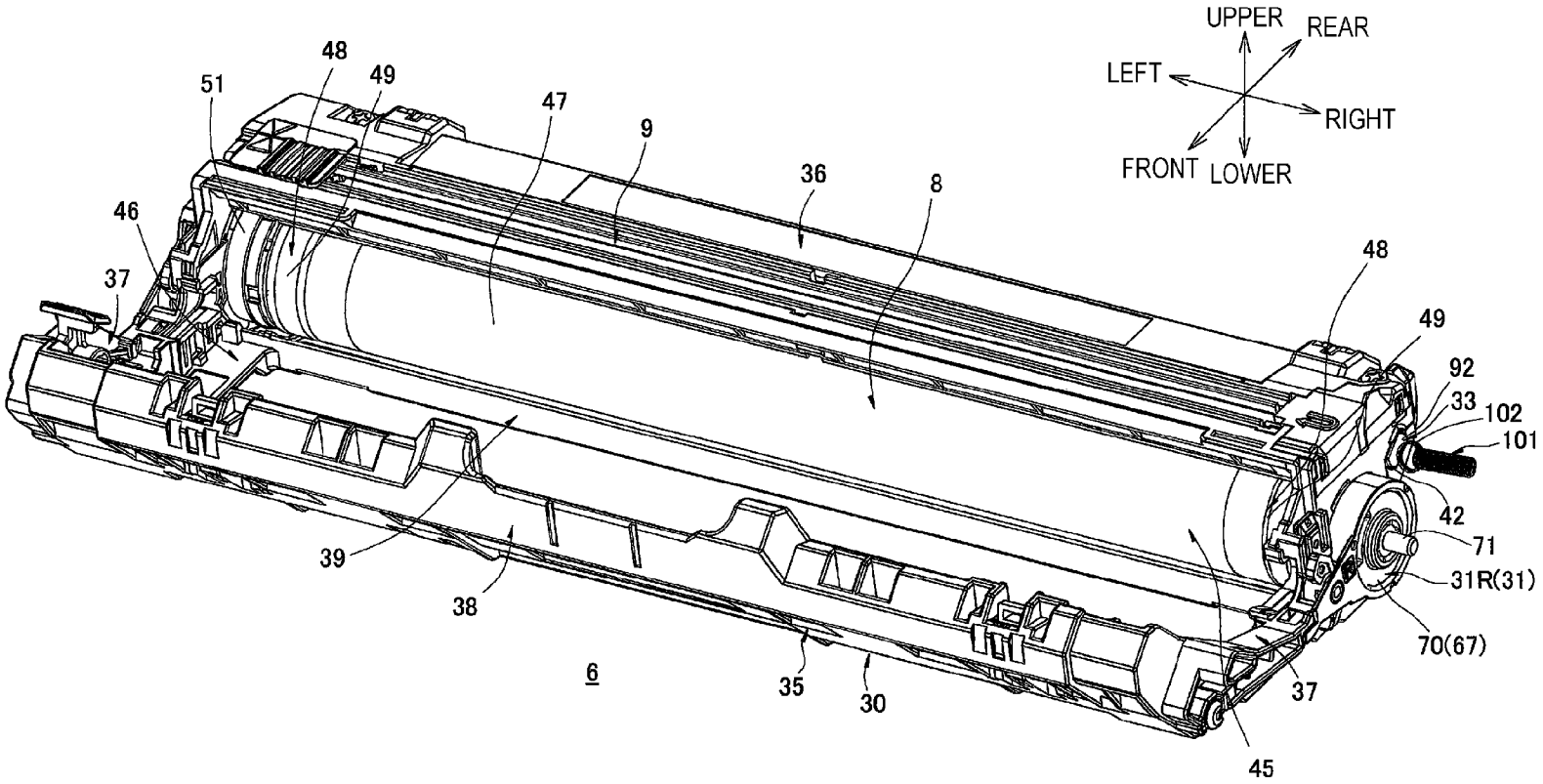
FIG. 2 is a perspective view of the drum cartridge shown in FIG. 1 as seen from the front upper side.
Figure 3A:
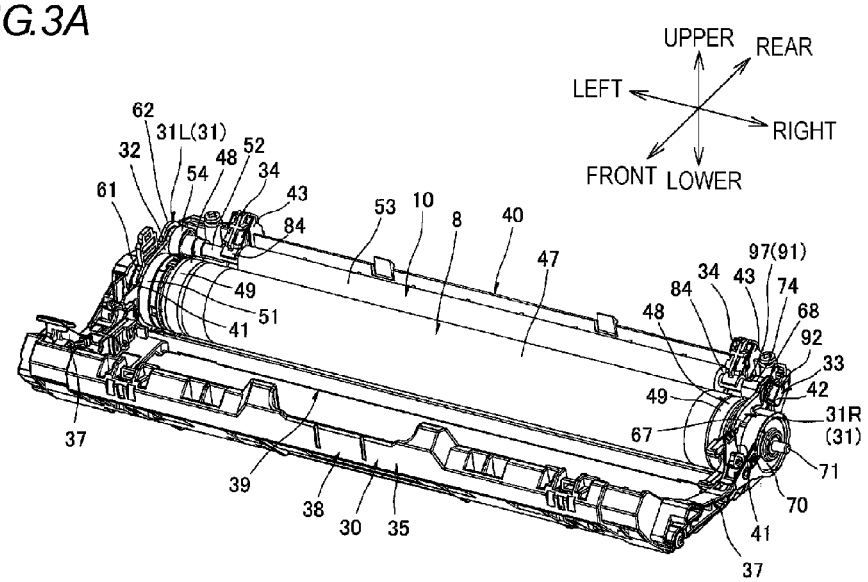
Figure 3B:
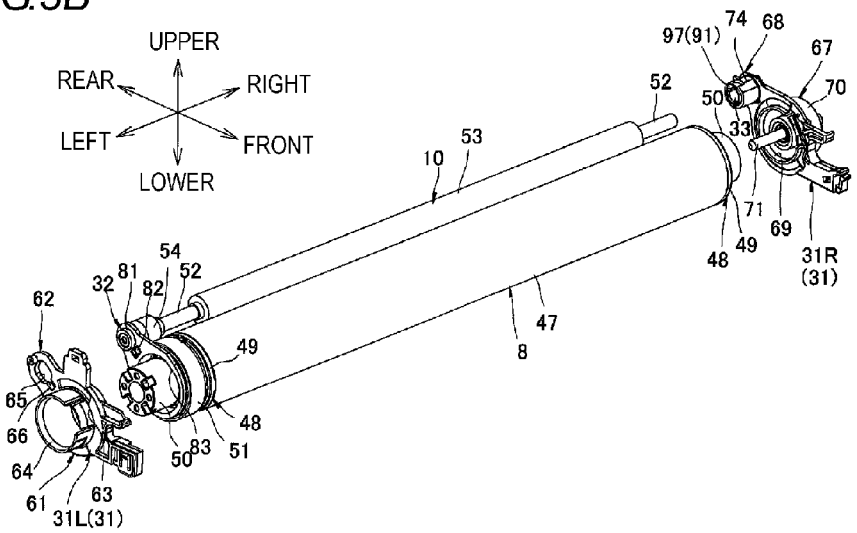

As shown in FIGS. 2, 3A, and 3B, the drum cartridge 6 includes a drum frame 30, a pair of left and right drum bearings 31, a drum cleaning electrode 33 (an example of a cartridge electrode), and a plurality of pressing members 34.

Incidentally, in the following description of the drum cartridge 6, when directions of the drum cartridge 6 are stated, the side at which the photosensitive drum 8 is disposed is referred to as the rear side of the drum cartridge 6, and the side at which the scorotron charger 9 is disposed is referred to as the upper side of the drum cartridge 6. That is, the vertical direction and front-rear direction of the drum cartridge 6 are different from the vertical direction and front-rear direction of the printer 1, and the drum cartridge 6 is installed in the printer 1 such that its rear side is positioned at the rear lower side of the printer 1, and its front side is positioned at the front upper side of the printer 1. In the drum cartridge 6 in a state where it is removed from the printer 1, the facing direction of the photosensitive drum 8 and the drum cleaning roller 10 is a direction connecting the rear upper side and the front lower side.

(1) Drum Frame

The drum frame 30 includes a base frame 35 and a cover frame 36.

The base frame 35 is formed in a bottomed frame shape having a substantially rectangular shape as seen in a plan view. The base frame 35 includes a pair of left and right side walls 37, a front wall 38, a lower wall 39, and a rear wall 40.

The pair of side walls 37 is formed in a substantially rectangular shape extending in the front-rear direction and the vertical direction as seen in a side view. Each side wall 37 has a bearing fitting portion 41. The right side wall 37 has an electrode exposing portion 42.

Each bearing fitting portion 41 is formed at the rear end portion of a corresponding side wall 37, substantially in a letter "U" shape recessed from the upper end portion of the corresponding side wall 37 toward the lower side as seen in a side view.

The electrode exposing portion 42 is disposed at the rear side of the bearing fitting portion 41 in the rear end portion of the right side wall 37, and is formed in a substantially rectangular shape recessed from the upper end portion of the right side wall 37 toward the lower side as seen in a side view.

The front wall 38 is disposed between the front end portions of the pair of side walls 37. The front wall 38 is formed substantially in a flat plate shape extending in the vertical direction.

The lower wall 39 is disposed between the lower end portions of the pair of side walls 37. The lower wall 39 is formed substantially in a flat plate shape connected to the lower end portion of the front wall 38 and extending toward the rear side.

The rear wall 40 is disposed between the rear end portions of the pair of the side walls 37. The rear wall 40 is formed substantially in a flat plate shape connected to the rear end portion of the lower wall 39 and extending toward the upper side. The rear wall 40 has a plurality of pressing-member accommodating portions 43.

The plurality of pressing-member accommodating portions 43 is disposed at the left and right end portions of the rear wall 40, respectively. Each pressing-member accommodating portion 43 is formed substantially in a rectangular frame shape extending in the front-rear direction and open at its front portion as seen in a plan view.

As shown in FIG. 1, at the connection portion of the rear end portion of the lower wall 39 and the lower end portion of the rear wall 40, a drum exposing opening 44, which is long in the left-right direction, is formed to expose the photosensitive drum 8 to the lower side.

As shown in FIG. 2, the cover frame 36 is formed substantially in a rectangular frame shape extending in the left-right direction, closed at its upper end portion, and open at its front end portion and lower end portion as seen in a plan view. The cover frame 36 is assembled with the rear end portion of the base frame 35 from the upper side, so as to cover the photosensitive drum 8 from the upper side. The cover frame 36 supports the scorotron charger 9.

Further, in the drum frame 30, a drum accommodating portion 45 is defined by the rear half of the lower wall 39, portions of the pair of side walls 37 corresponding to the rear half of the lower wall 39, and the cover frame 36.

Also, in the drum frame 30, a developing-cartridge mounting portion 46 for mounting the developing cartridge 7 is defined by the front half of the lower wall 39, portions of the pair of side walls 37 corresponding to the front half of the lower wall 39, the front wall 38, and the front edge of the cover frame 36.

(2) Photosensitive Drum and Drum Cleaning Roller

As shown in FIGS. 2, 3A, and 3B, the photosensitive drum 8 is accommodated inside the front end portion of the drum accommodating portion 45. The photosensitive drum 8 includes a main drum body 47 and a pair of left and right flange members 48.

The main drum body 47 is formed of a metal in a substantially cylindrical shape extending in the left-right direction. A photosensitive layer is formed on the outer circumferential surface of the main drum body 47.

The pair of flange members 48 is fixed to the left and right end portions of the main drum body 47, respectively. Each flange member 48 is formed of a resin, and integrally has an insertion portion 49 and a supported portion 50.

The insertion portion 49 is the inner half of the flange member 48 in the left-right direction, and is formed in a substantially columnar shape extending in the left-right direction. The insertion portion 49 is non-rotatably inserted into the main drum body 47. A drum drive gear 51 is provided at the left end portion of the insertion portion 49 of the left flange member 48.

The supported portion 50 is the outer half of the flange member 48 in the left-right direction, and is formed in the substantially columnar shape protruding from the central portion of the insertion portion 49 toward the outer side in the left-right direction. The outside diameter of the supported portion 50 is smaller than the outside diameter of the insertion portion 49. The supported portion 50 shares a central axis with the insertion portion 49.

As shown in FIGS. 3A and 3B, the drum cleaning roller 10 is disposed inside the rear end portion of the drum accommodating portion 45. The drum cleaning roller 10 includes a roller shaft 52 and a main roller body 53.

The roller shaft 52 is formed of a metal in a substantially columnar shape extending in the left-right direction. A cleaning-roller drive gear 54 is non-rotatably provided at the left end portion of the roller shaft 52 and is engaged with the drum drive gear 51 of the left flange member 48.

The main roller body 53 is formed of sponge in a substantially cylindrical shape to cover the central portion of the roller shaft 52 in the left-right direction and exposes the left and right end portions of the roller shaft 52.

(3) Configuration Related to Bearings of Photosensitive Drum (3-1) Left Drum Bearing The left drum bearing 31 (an example of a second side wall) is supported on the left side wall 37 of the drum frame 30 and rotatably supports the left end portion of the photosensitive drum 8. Incidentally, in the following description, the left drum bearing 31 is referred to as the left drum bearing 31L. The left drum bearing 31L is formed substantially in a flat plate shape which extends in the front-rear direction and whose central portion in the left-right direction protrudes substantially in a circular shape. The left drum bearing 31L integrally has a flange supporting portion 61 and a cleaning-bearing supporting portion 62.

The flange supporting portion 61 is formed substantially at the center of the left drum bearing 31L in the left-right direction, substantially in a circular plate shape. The flange supporting portion 61 has a flange supporting hole 63 and a collar portion 64.

The flange supporting hole 63 is formed in the central portion of the flange supporting portion 61 in a substantially circular shape as seen in a side view. The diameter of the flange supporting hole 63 is substantially the same as the outside diameter of the supported portion 50 of the left flange member 48.

The collar portion 64 is formed in a substantially cylindrical shape protruding from the circumferential edge portion of the flange supporting hole 63 toward the left side. The inside diameter of the collar portion 64 is the same as the inside diameter of the flange supporting hole 63. The outside diameter of the collar portion 64 is substantially the same as the length of the bearing fitting portion 41 of the left side wall 37 in the front-rear direction. The supported portion 50 of the left flange member 48 is fit into the collar portion 64 through the flange supporting hole 63 so as to be relatively rotatable. The collar portion 64 is fit into the bearing fitting portion 41 of the left side wall 37.

The cleaning-bearing supporting portion 62 is formed substantially in a flat plate shape extending from the rear upper end portion of the flange supporting portion 61 toward the rear upper side. The cleaning-bearing supporting portion 62 is formed with a cleaning-bearing supporting hole 65 and a bearing locking groove 66.

The cleaning-bearing supporting hole 65 is a hole extending in the direction connecting the rear upper side and the front lower side, and penetrating through the cleaning-bearing supporting portion 62 in the left-right direction.

The bearing locking groove 66 is formed substantially in a letter "U" shape open at its rear upper side as seen in a side view, for example, by notching the cleaning-bearing supporting portion 62 from the front lower end portion of the cleaning-bearing supporting hole 65 toward the front lower side.

(3-2) Right Drum Bearing

As shown in FIGS. 3A to 4B, the right drum bearing 31 (an example of a first side wall) is supported on the right side wall 37 of the drum frame 30 and rotatably supports the right end portion of the photosensitive drum 8. Incidentally, in the following description, the right drum bearing 31 is referred to as the right drum bearing 31R. The right drum bearing 31R is formed substantially in a flat plate shape which extends in the front-rear direction and whose central portion in the left-right direction protrudes substantially in a circular shape. The right drum bearing 31R has a flange supporting portion 67 and an electrode supporting portion 68 formed integrally with the right drum bearing 31R.

The flange supporting portion 67 is formed substantially at the center of the right drum bearing 31R in the left-right direction, substantially in a circular plate shape. The flange supporting portion 67 has a flange supporting hole 69 and a collar portion 70.

The flange supporting hole 69 is formed in the central portion of the flange supporting portion 67 in a substantially circular shape as seen in a side view. The diameter of the flange supporting hole 69 is substantially the same as the outside diameter of the supported portion 50 of the right flange member 48.

The collar portion 70 is formed in a substantially cylindrical shape protruding from the circumferential edge portion of the flange supporting hole 63 toward the right side and closed at its right end portion. The inside diameter of the collar portion 70 is the same as the diameter of the flange supporting hole 69. The outside diameter of the collar portion 70 is substantially the same as the length of the bearing fitting portion 41 of the right side wall 37 in the front-rear direction. The supported portion 50 of the right flange member 48 is fit into the collar portion 70 through the flange supporting hole 69 so as to be relatively rotatable. The collar portion 70 is fit into the bearing fitting portion 41 of the right side wall 37. The collar portion 70 has a shaft 71.

The shaft 71 is supported at the radial center of the collar portion 70 so as to penetrate through the right wall of the collar portion 70. The shaft 71 is formed of a conductive material such as a metal, in a substantially columnar shape extending in the left-right direction. In a state where the drum cartridge 6 is mounted in the main body casing 2, the shaft 71 is brought into contact with a ground electrode (not shown) of the main body casing 2 so as to ground the main drum body 47 of the photosensitive drum 8.

The electrode supporting portion 68 is formed substantially in a flat plate shape extending from the end portion of the rear upper side of the flange supporting portion 67 toward the rear upper side. The electrode supporting portion 68 has an electrode supporting hole 72 (an example of an opening portion), a roller-shaft abutting portion 73 (an example of an abutting portion), and an electrode supporting cylinder 74.

The electrode supporting hole 72 is a hole extending in the direction connecting the rear upper side and the front lower side and penetrating through the electrode supporting portion 68 in the left-right direction. The length of the electrode supporting hole 72 in the direction connecting the rear upper side and the front lower side is larger than the outside diameter of a roller-shaft holding portion 91 (described later) of the drum cleaning electrode 33. The length of the electrode supporting hole 72 in a direction connecting the front upper side and the rear lower side is substantially the same as the outside diameter of the roller-shaft holding portion 91 (described later) of the drum cleaning electrode 33.

The roller-shaft abutting portion 73 is disposed inside the electrode supporting hole 72. The roller-shaft abutting portion 73 is formed in a substantially prismatic shape extending in the direction connecting the rear upper side and the front lower side. The roller-shaft abutting portion 73 is disposed substantially at the center of the inside of the electrode supporting hole 72 in the direction connecting the front upper side and the rear lower side. The roller-shaft abutting portion 73 is disposed inside the electrode supporting hole 72 such that the rear upper end portion of the roller-shaft abutting portion 73 is connected to the inner surface of the rear upper side of the electrode supporting hole 72, and the front lower end portion of the roller-shaft abutting portion 73 is connected to the inner surface of the front lower side of the electrode supporting hole 72. That is, the roller-shaft abutting portion 73 is disposed to overlap the electrode supporting hole 72 when the roller-shaft abutting portion 73 is projected in the direction connecting the front upper side and the rear lower side. The thickness of the roller-shaft abutting portion 73 in the left-right direction is larger than the thickness of the roller-shaft abutting portion 73 in the direction connecting the front upper side and the rear lower side. The direction connecting the rear upper side and the front lower side is an example of a facing direction of the photosensitive drum 8 and the drum cleaning roller 10 and an example of a direction orthogonal to the axial direction of the photosensitive drum 8. The roller-shaft abutting portion 73 has a protruding portion 75.

The protruding portion 75 is formed substantially in a semicircular shape as seen in a side view, so as to protrude from the front upper surface of the left end portion of the roller-shaft abutting portion 73 toward the front upper side.

The electrode supporting cylinder 74 is formed in a substantially cylindrical shape protruding from the circumferential edge portion of the electrode supporting hole 72 toward the left side. The electrode supporting cylinder 74 has an engaging recess portion 76, and guide portions 77 (examples of a plurality of engaging portions).

The engaging recess portion 76 is formed substantially in a letter "U" shape open at its left end portion as seen in a plan view, for example, by notching the electrode supporting cylinder 74 from the left edge of the upper circumferential wall of the electrode supporting cylinder 74 toward the right side.

The plurality of guide portions 77 are provided at the rear upper end portion and front lower end portion of the electrode supporting cylinder 74, respectively. The rear upper guide portion 77 is a ridge protruding from the inner surface of the rear upper end portion of the electrode supporting cylinder 74 toward the front lower side and extending in the left-right direction. The rear upper guide portion 77 is connected to the rear upper end portion of the roller-shaft abutting portion 73. The right end portion of the front lower guide portion 77 is a ridge protruding from the inner surface of the front lower end portion of the electrode supporting cylinder 74 and extending in the left-right direction. The right end portion of the front lower guide portion 77 is connected to the front lower end portion of the roller-shaft abutting portion 73.

(4) Configuration Related to Bearing of Drum Cleaning Roller (4-1) Cleaning Roller Bearing As shown in FIGS. 3A and 3B, a cleaning roller bearing 32 is disposed on the right side of the left flange member 48, and rotatably supports the left end portion of the drum cleaning roller 10. The cleaning roller bearing 32 is formed in a flat plate shape which has substantially a teardrop shape such that the rear end portion is narrow, as seen in a side view. The cleaning roller bearing 32 has a bearing portion 81, a locking boss 82, and a flange insertion hole 83.

The bearing portion 81 is formed at the rear end portion of the cleaning roller bearing 32 in a substantially cylindrical shape penetrating through the cleaning roller bearing 32 in the left-right direction and protruding from the left surface of the cleaning roller bearing 32 toward the left side. The inside diameter of the bearing portion 81 is substantially the same as the outside diameter of the roller shaft 52. The outside diameter of the bearing portion 81 is smaller than the length of the cleaning-bearing supporting hole 65 in the direction connecting the rear upper side and the front lower side, and is substantially the same as the length of the cleaning-bearing supporting hole 65 in the direction connecting the front upper side and the rear lower side. The left end portion of the roller shaft 52 is fit into the bearing portion 81 from the left side of the cleaning-roller drive gear 54. The bearing portion 81 is fit into the cleaning-bearing supporting hole 65 of the left drum bearing 31L, so as to be movable in the direction connecting the rear upper side and the front lower side.

The locking boss 82 is disposed on the front lower side of the bearing portion 81, and is formed in a substantially prismatic shape protruding from the left surface of the cleaning roller bearing 32 toward the left side. The locking boss 82 is fit into the bearing locking groove 66 of the left drum bearing 31L with clearance.

The flange insertion hole 83 is disposed on the front side of the locking boss 82 at the front end portion of the cleaning roller bearing 32. The flange insertion hole 83 is formed in a hole shape long in the front-rear direction as seen in a side view. The length of the flange insertion hole 83 in the direction connecting the front upper side and the rear lower side is larger than the outside diameter of the supported portion 50 of the left flange member 48. The length of the flange insertion hole 83 in the direction connecting the rear upper side and the front lower side is larger than the length of the flange insertion hole 83 in the direction connecting the front upper side and the rear lower side. The supported portion 50 of the left flange member 48 is inserted into the flange insertion hole 83, so as not to come into contact with the inner surface of the flange insertion hole 83.

(4-2) Drum Cleaning Electrode

As shown in FIGS. 5A to 5D, the drum cleaning electrode 33 is formed of a conductive resin such as polyacetal resin, in a substantially cylindrical shape extending in the left-right direction and closed at its right end portion. The drum cleaning electrode 33 integrally has a main-body-electrode contact portion 92 (an example of a second contact portion), the roller-shaft holding portion 91 (an example of a holding portion), and a roller-shaft contact portion 93 (an example of a first contact portion).

The main-body-electrode contact portion 92 is disposed at the right end portion of the drum cleaning electrode 33, and is formed in a flat plate shape which has substantially a rectangular shape extending toward the rear upper side and the front lower side.

The roller-shaft holding portion 91 is formed in a substantially cylindrical shape extending from the left surface of the main-body-electrode contact portion 92 toward the left side. The roller-shaft holding portion 91 has a first holding part 94 and a second holding part 95.

Figure 8A:
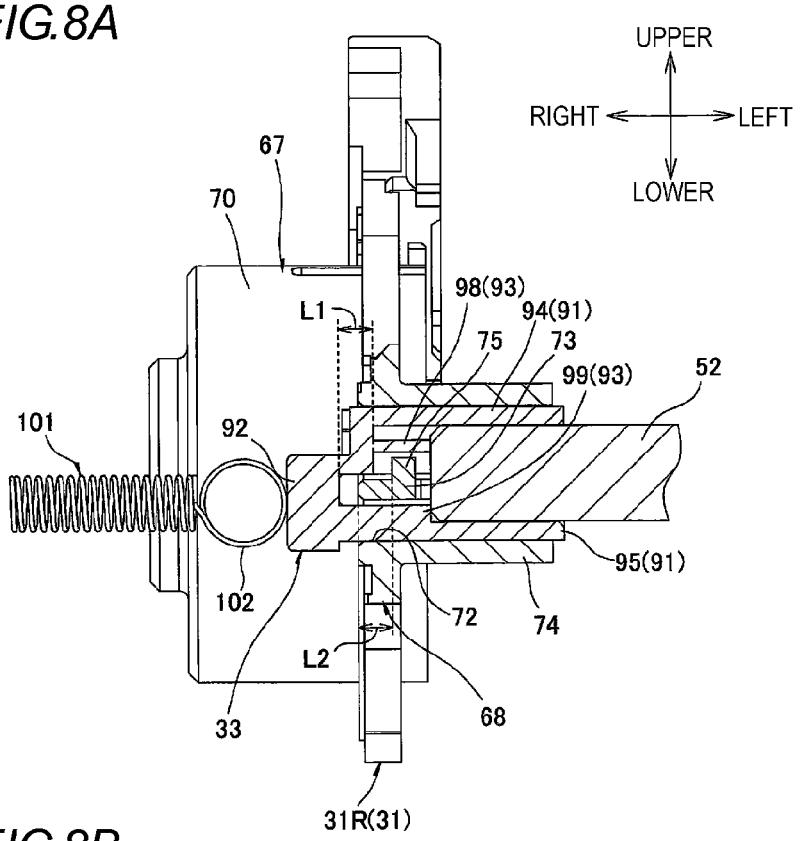

The first holding part 94 is disposed on the left side of the front upper end portion of the main-body-electrode contact portion 92. The first holding part 94 is formed substantially in a half cylinder shape extending in the left-right direction and closed at its right end portion. The right end portion of the rear lower end portion of the first holding part 94 is connected to the front upper end portion of the main-body-electrode contact portion 92. The first holding part 94 has a pair of notches 96 and a locking claw 97. Also, as shown in FIG. 8A, a distance L1 in the left-right direction between the left surface of the right wall of the first holding part 94 and the left surface of the main-body-electrode contact portion 92 is substantially the same as a distance L2 in the left-right direction between the right edge of the roller-shaft abutting portion 73 and the right surface of the protruding portion 75.

As shown in FIGS. 5A to 5D, the pair of notches 96 are formed from the left edge of the upper circumferential wall of the first holding part 94 toward the right side, at an interval in the circumferential direction of the first holding part 94. The notches 96 are formed at the left half of the first holding part 94.

The locking claw 97 is disposed between the pair of notches 96, and is formed substantially in a hook shape extending in the left-right direction and curved upward at its left end portion.

The second holding part 95 is disposed to face the rear lower side of the first holding part 94 with a gap. The second holding part 95 is formed in a partially cylindrical shape extending from the left surface of the rear lower end portion of the main-body-electrode contact portion 92 toward the left side and having the same curvature center and curvature radius as those of the first holding part 94. The rear upper end portion of the second holding part 95 is disposed to face the rear lower side of the rear upper end portion of the first holding part 94 with a gap. The front lower end portion of the second holding part 95 is disposed to face the rear lower side of the front lower end portion of the first holding part 94 with a gap.

A portion between the rear upper end portion of the first holding part 94 and the rear upper end portion of the second holding part 95, and a portion between the front lower end portion of the first holding part 94 and the front lower end portion of the second holding part 95 are guide grooves 100 (examples of engaged portions).

The roller-shaft contact portion 93 is disposed on the inner side in the radial direction of the roller-shaft holding portion 91. The roller-shaft contact portion 93 has a first abutting part 98, and a second abutting part 99.

The first abutting part 98 is formed substantially in a half cylinder shape protruding from the inner surface of the right side of the first holding part 94 and sharing a central axis with the first holding part 94. The rear lower edge of the first abutting part 98 is disposed to overlap the rear lower edge of the first holding part 94 as seen in a side view. The length of the first abutting part 98 in the left-right direction is larger than the length of the protruding portion 75 of the right drum bearing 31R in the left-right direction.

The second abutting part 99 is formed in a substantially prismatic shape extending from the left surface of the main-body-electrode contact portion 92 toward the left side. The rear lower end portion of the second abutting part 99 is connected to the inner circumferential surface of the rear lower side of the second holding part 95. The front upper end portion of the second abutting part 99 extends along a virtual line L connecting the rear upper end portion and front lower end portion of the second holding part 95 as seen in a side view. Also, as shown in FIG. 8A, the left edge of the second abutting part 99 is disposed to overlap the left edge of the first abutting part 98 when the second abutting part 99 is projected in the direction connecting the front upper side and the rear lower side.

Figure 6:
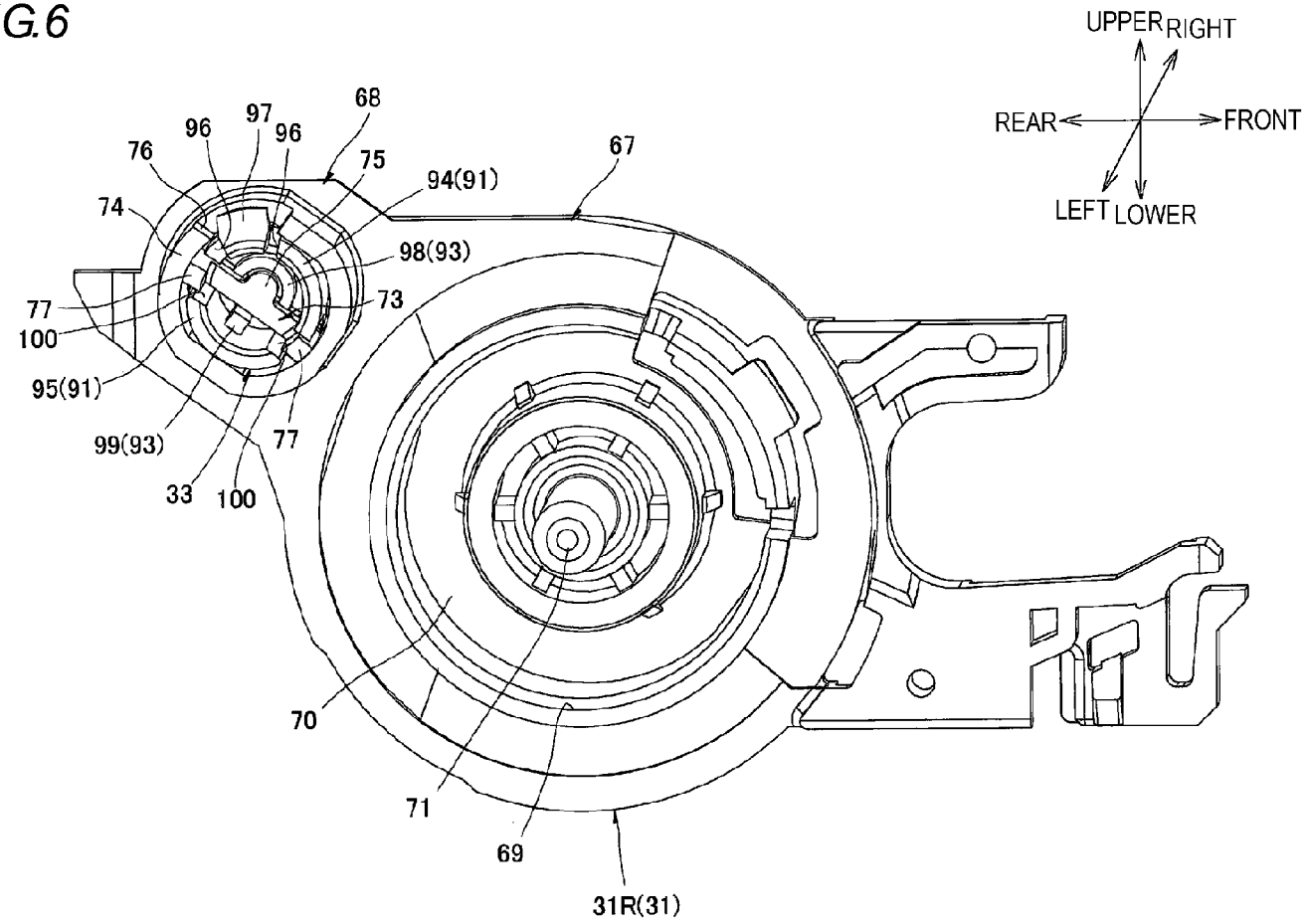
FIG. 6 is an explanatory view showing the assembled state of the drum cleaning electrode with the right drum bearing.
Figure 7:
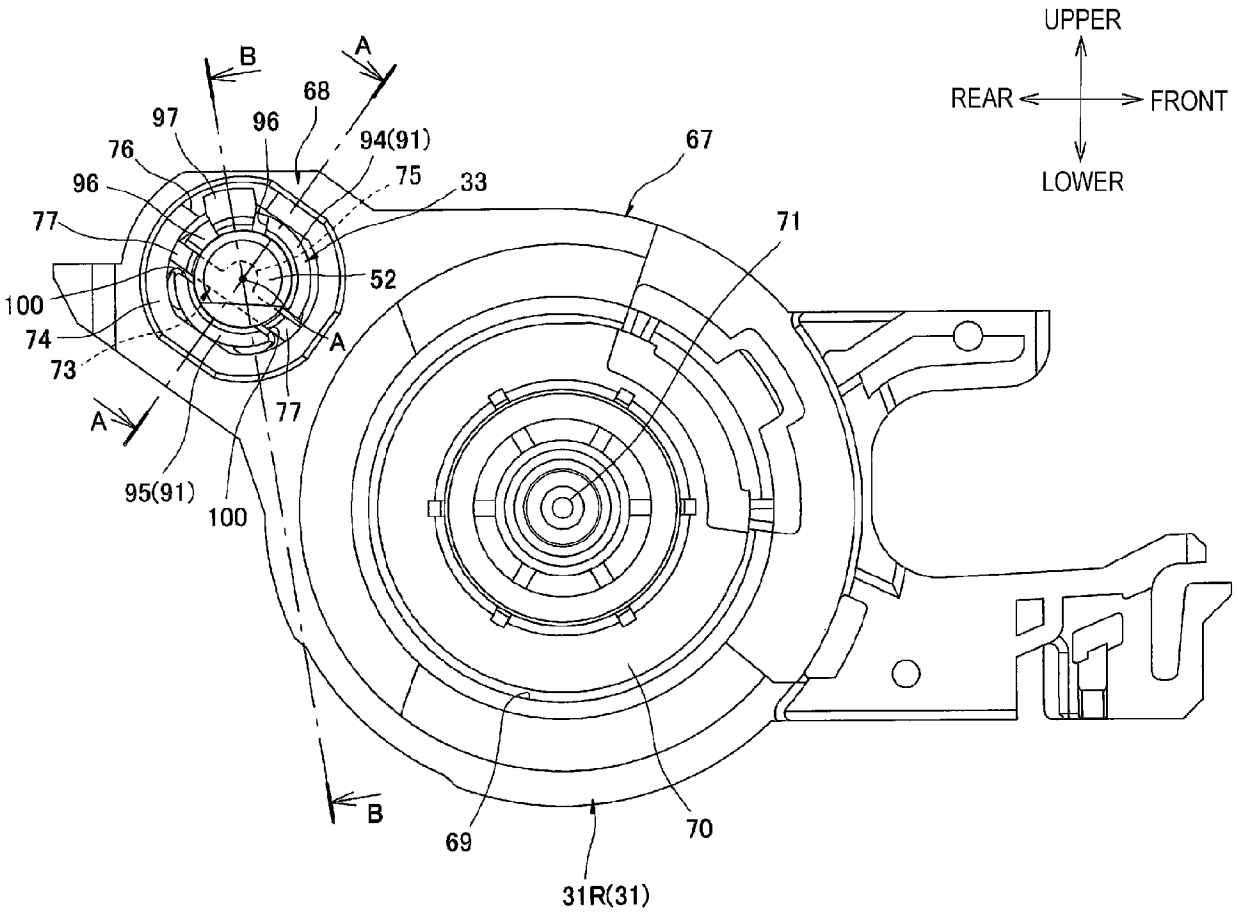
FIG. 7 is an explanatory view showing a contact state of the drum cleaning electrode and a roller shaft.

Further, as shown in FIGS. 6 and 7, the drum cleaning electrode 33 is fit into the electrode supporting hole 72 of the right drum bearing 31R from the right side, so as to slightly move in the direction connecting the rear upper side and the front lower side.

In this state, the main-body-electrode contact portion 92 is disposed at the right side of the right drum bearing 31R. That is, the main-body-electrode contact portion 92 is disposed at an opposite side to the drum cleaning roller 10 with respect to the right drum bearing 31R, so as to overlap the drum cleaning roller 10 when the main-body-electrode contact portion 92 is projected in the left-right direction. Also, as shown in FIGS. 3A and 3B, the main-body-electrode contact portion 92 is fit into the electrode exposing portion 42 of the base frame 35 with clearance.

As shown in FIGS. 6 and 7, the roller-shaft abutting portion 73 is fit between the first abutting part 98 and the second abutting part 99, so as to be movable in the direction connecting the rear upper side and the front lower side. The protruding portion 75 is fit into the first abutting part 98 with clearance. The guide portions 77 are fit into corresponding guide grooves 100, so as to be movable in the direction connecting the rear upper side and the front lower side.

Figure 8B:
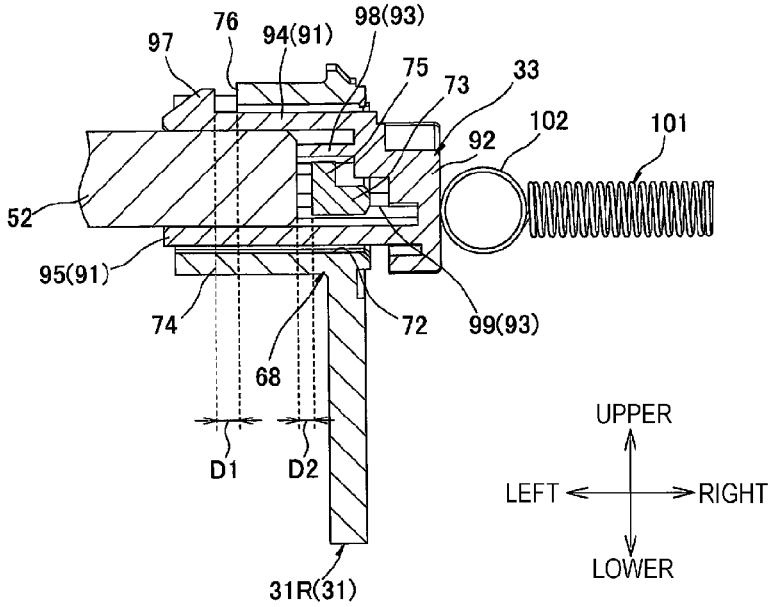

As shown in FIGS. 7, 8A, and 8B, the left end portion of the locking claw 97 is freely fit into the engaging recess portion 76. The drum cleaning electrode 33 is movable toward the right side until the left end portion of the locking claw 97 abuts on the inner circumferential surface of the right side of the engaging recess portion 76 as shown in FIGS. 9A and 9B.

Figure 9A:
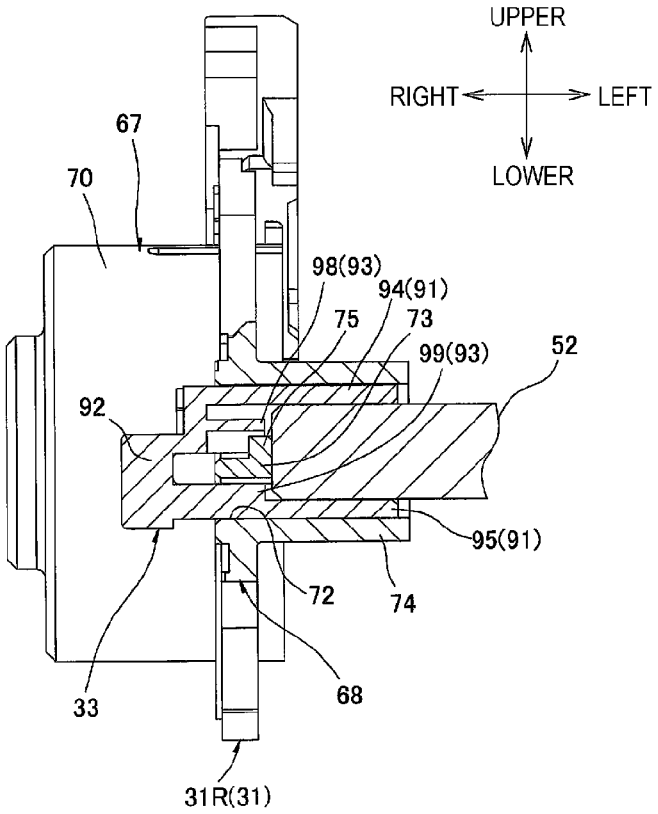
Figure 9B:
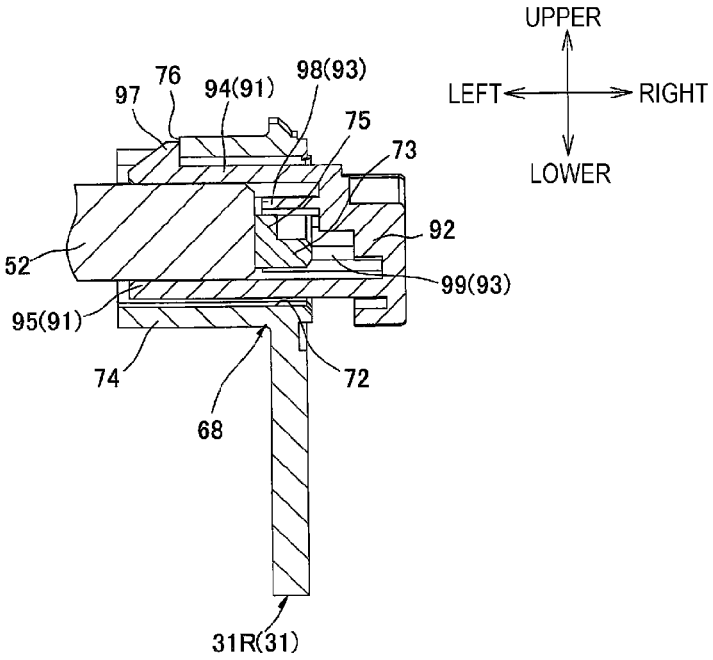

When the left end portion of the locking claw 97 abuts on the inner circumferential surface at the right side of the engaging recess portion 76, as shown in FIG. 9A, the left edges of the first abutting part 98 and the second abutting part 99 are disposed at the right side with respect to the left surface of the roller-shaft abutting portion 73.

The drum cleaning electrode 33 is fit into the right end portion of the roller shaft 52 from the outer side in the radial direction of the roller shaft 52, such that the roller-shaft holding portion 91 comes into contact with the circumferential surface of the roller shaft 52 as shown in FIGS. 3A, 3B, 8A, and 8B, so as to be relatively rotatable.

In this state, the protruding portion 75 is disposed to overlap the axis A of the drum cleaning roller 10 as shown in FIG. 7. That is, the protruding portion 75 of the roller-shaft abutting portion 73 is disposed at a position closer to the axis A of the drum cleaning roller 10 than the first abutting part 98 and the second abutting part 99. The drum cleaning electrode 33 is movable toward the left side until the first abutting part 98 and the second abutting part 99 abut on the left edge of the roller shaft 52.

When the first abutting part 98 and the second abutting part 99 abut on the left edge of the roller shaft 52, the left edges of the first abutting part 98 and the second abutting part 99 are disposed at the left side with respect to the left surface of the roller-shaft abutting portion 73.

(5) Pressing Members

As shown in FIGS. 3A and 3B, the plurality of pressing members 34 is fit into the plurality of pressing-member accommodating portions 43, respectively, so as to be slidable in a direction connecting the rear lower side and the front upper side. Each pressing member 34 is formed in a substantially prismatic shape extending in the direction connecting the rear upper side and the front lower side. Each pressing member 34 has a shaft abutting portion 84.

The shaft abutting portion 84 is provided at the front lower end portion of the corresponding pressing member 34, and is formed in a substantially cylindrical shape extending in the left-right direction and open at its front lower end portion. The shaft abutting portion 84 is fit onto the roller shaft 52 of the drum cleaning roller 10 from the rear upper side, so as to be relatively rotatable.

The pressing members 34 are always pressed toward the front lower side by pressing forces of compression springs (not shown).

3. Main Body Electrode

As shown in FIG. 2, the main body casing 2 is provided with a main body electrode 101 in the vicinity of the right of the process cartridge 5.

The main body electrode 101 is formed of a material having conductivity and elasticity, such as a metal, in a spiral shape extending in the left-right direction. Also, the left end portion of the main body electrode 101 is provided with a contact portion 102 which has a substantially annular shape. The main body electrode 101 is electrically connected to a power source (not shown) of the inside of the main body casing 2.

4. Positioning of Cleaning Roller

When the process cartridge 5 is mounted in the main body casing 2, as shown in FIGS. 2, 8A, and 8B, the right surface of the main-body-electrode contact portion 92 of the drum cleaning electrode 33 of the process cartridge 5 is moved so as to abut on the contact portion 102 of the main body electrode 101 from the left side.

Then, the drum cleaning electrode 33 is pressed toward the left side by the elasticity of the main body electrode 101.

Then, the drum cleaning electrode 33 is moved such that the first abutting part 98 and the second abutting part 99 abut on the right end surface of the roller shaft 52, and the drum cleaning electrode 33 presses the roller shaft 52 toward the left side.

As a result, the drum cleaning roller 10 is moved together with the drum cleaning electrode 33 toward the left side, so as to be pressed against the inner surface of the left side wall 37 of the drum frame 30 through the cleaning roller bearing 32 and the left drum bearing 31L.

In this way, the drum cleaning roller 10 is positioned in the left-right direction.

At this time, a distance D1 in the left-right direction between the left end portion of the locking claw 97 and the inner circumferential surface at the right side of the engaging recess portion 76 is larger than a distance D2 in the left-right direction between the right end portion of the roller shaft 52 and the roller-shaft abutting portion 73.

The distance D1 in the left-right direction between the left end portion of the locking claw 97 and the inner circumferential surface at the right side of the engaging recess portion 76 is a movable distance of the drum cleaning electrode 33 toward the right side. The distance D2 in the left-right direction between the right end portion of the roller shaft 52 and the roller-shaft abutting portion 73 is a movable distance of the drum cleaning roller 10 toward the right side. That is, the movable distance of the drum cleaning electrode 33 toward the right side is larger than the movable distance of the drum cleaning roller 10 toward the right side.

5. Cleaning Operation

Hereinafter, with reference to FIGS. 1 to 3B, an operation of cleaning the surface of the photosensitive drum 8 by the drum cleaning roller 10 will be described.

If the process cartridge 5 is mounted in the main body casing 2, and a driving force from a driving source (not shown) of the inside of the main body casing 2 is input to the photosensitive drum 8, the photosensitive drum 8 is rotated around its central axis such that the driving force is transmitted to the cleaning-roller drive gear 54 through the drum drive gear 51.

Then, the driving force is transmitted from the cleaning-roller drive gear 54 to the roller shaft 52 such that the drum cleaning roller 10 is rotated.

At this time, the drum cleaning roller 10 is elastically moved slightly in the front-rear direction, according to the rotation of the photosensitive drum 8.

Thereafter, if a cleaning bias is input from the power source (not shown) of the inside of the main body casing 2 to the drum cleaning electrode 33 through the main body electrode 101, substances such as toner and sheet powder attached on the circumferential surface of the photosensitive drum 8 is transferred onto the drum cleaning roller 10.

As a result, the circumferential surface of the photosensitive drum 8 is cleaned.

6. Retraction of Drum Cleaning Electrode

When performing maintenance operation to the developing cartridge 7 and the drum cartridge 6, the drum exposing opening 44 is opened, and the process cartridge 5 is removed from the main body casing 2 through the main body opening 3, so that maintenance operation is performed to the developing cartridge 7 and the drum cartridge 6. At this time, a user may drop the drum cartridge 6 by mistake.

In this case, as shown in FIGS. 9A and 9B, due to the impact of the dropping, the drum cleaning roller 10 may move toward the right side.

The drum cleaning electrode 33 is pressed by the roller shaft 52 of the drum cleaning roller 10, so as to move toward the right side.

At this time, the roller shaft 52 of the drum cleaning roller 10 moves such that the right end surface of the roller shaft 52 abuts on the roller-shaft abutting portion 73 of the right drum bearing 31R from the left side, whereby the roller shaft 52 is regulated to move further to the right side with respect to the roller-shaft abutting portion 73.

Meanwhile, the drum cleaning electrode 33 is moved more to the right side until the left end portion of the locking claw 97 abuts on the inner circumferential surface at the right side of the engaging recess portion 76 such that the first abutting part 98 and the second abutting part 99 are disposed at the right side with respect to the roller-shaft abutting portion 73.

Then, the first abutting part 98 and the second abutting part 99 of the drum cleaning electrode 33 are separated from the right end portion of the roller shaft 52 toward the right side.

Therefore, the load of the drum cleaning roller 10 can be prevented from being applied to the first abutting part 98 and the second abutting part 99 of the drum cleaning electrode 33.

7. Operational Effects (1) According to the drum cartridge 6, as shown in FIGS. 9A and 9B, the drum cleaning electrode 33 is configured such that the first abutting part 98 and the second abutting part 99 move to further right side than the roller-shaft abutting portion 73.

Therefore, for example, when the drum cartridge 6 is dropped by mistake, it is possible to move the drum cleaning electrode 33 toward the right side such that the first abutting part 98 and the second abutting part 99 are disposed at further right side than the roller-shaft abutting portion 73 while the roller shaft 52 of the drum cleaning roller 10 abuts on the roller-shaft abutting portion 73 of the right drum bearing 31R.

Therefore, it is possible to separate the first abutting part 98 and the second abutting part 99 of the drum cleaning electrode 33 from the roller shaft 52 of the drum cleaning roller 10 while receiving the load of the drum cleaning roller 10 by the roller-shaft abutting portion 73, and thus to prevent the load of the drum cleaning roller 10 from acting on the drum cleaning electrode 33.

As a result, it is possible to suppress the drum cleaning electrode 33 from being broken, for example, when the drum cartridge 6 is dropped by mistake.

(2) Also, according to the drum cartridge 6, as shown in FIGS. 6 and 7, the protruding portion 75 of the roller-shaft abutting portion 73 overlaps the axis A of the drum cleaning roller 10.

Therefore, the roller-shaft abutting portion 73 can abut on the drum cleaning roller 10 at the rotation center of the drum cleaning roller 10.

As a result, the drum cleaning roller 10 can surely abut on the roller-shaft abutting portion 73, and thus, the load of the drum cleaning roller 10 can be surely prevented from acting on the drum cleaning electrode 33.

(3) Also, according to the drum cartridge 6, as shown in FIGS. 8A and 8B, when the first abutting part 98 and the second abutting part 99 of the drum cleaning electrode 33 contact the left end portion of the roller shaft 52, the distance D1 in the left-right direction between the left end portion of the locking claw 97 and the inner circumferential surface at the right side of the engaging recess portion 76 is larger than the distance D2 in the left-right direction between the right end portion of the roller shaft 52 and the roller-shaft abutting portion 73.

Therefore, the drum cleaning electrode 33 can be moved toward the right side by a movement distance larger than the movement distance of the drum cleaning roller 10.

As a result, the drum cleaning electrode 33 can be surely separated from the roller shaft 52 of the drum cleaning roller 10.

(4) Also, according to the drum cartridge 6, as shown in FIGS. 3A, 3B, 8A, and 8B, the drum cleaning electrode 33 can be used to rotatably hold the drum cleaning roller 10.

Therefore, supplying of electric power to the drum cleaning roller 10 and holding of the drum cleaning roller 10 can be achieved while reducing the number of components, without separately providing a member for holding the drum cleaning roller 10.

(5) Also, according to the drum cartridge 6, as shown in FIGS. 3A, 3B, and 7, in the cleaning operation, the drum cleaning roller 10 is moved in the facing direction of the photosensitive drum 8 and the drum cleaning roller 10.

Therefore, the drum cleaning roller 10 can follow the rotation of the photosensitive drum 8, and the drum cleaning roller 10 can be surely brought into contact with the photosensitive drum 8.

Also, the drum cleaning electrode 33 which is to be rotatably fit onto the right end portion of the drum cleaning roller 10 is fit into the electrode supporting hole 72 of the electrode supporting portion 68 of the right drum bearing 31R so as to be movable in the facing direction of the photosensitive drum 8 and the drum cleaning roller 10.

Therefore, the drum cleaning electrode 33 can follow the movement of the drum cleaning roller 10 and the drum cleaning electrode 33 can be surely brought into contact with the roller shaft 52 of the drum cleaning roller 10.

(6) Also, according to the drum cartridge 6, the rotation of the drum cleaning electrode 33 following the rotation of the drum cleaning roller 10 can be regulated by engagement of the guide portions 77 of the right drum bearing 31R and the guide grooves 100 of the drum cleaning electrode 33 as shown in FIG. 6.

Therefore, the main-body-electrode contact portion 92 of the drum cleaning electrode 33 and the main body electrode 101 can be surely brought into contact with each other, and electric power can be surely supplied from the main body casing 2 to the drum cleaning electrode 33.

Figure 4A:
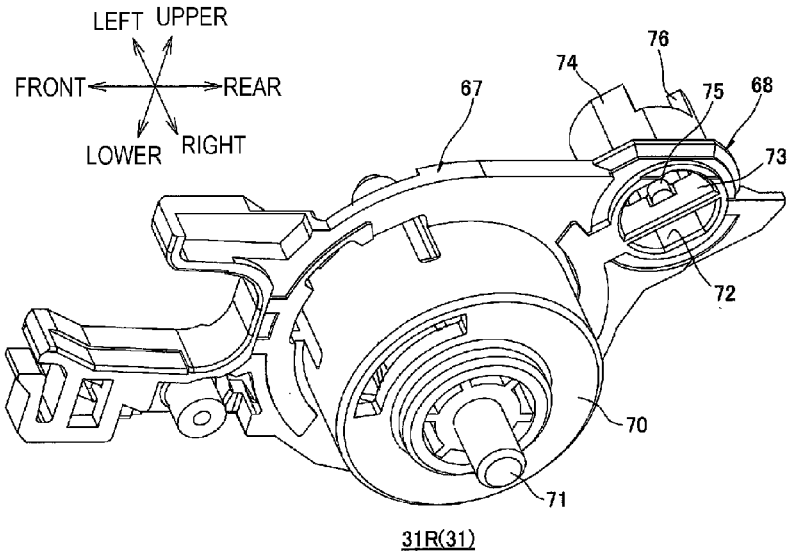
FIGS. 4A and 4B are perspective views showing a right drum bearing shown in FIGS. 3A and 3B, as seen from the right upper side and as seen from the left upper side, respectively.
Figure 4B:
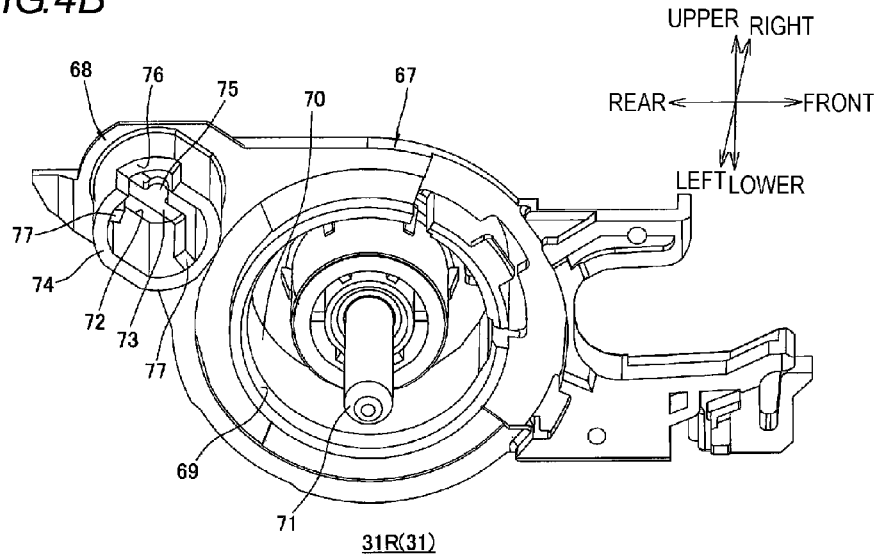
Figure 5A:
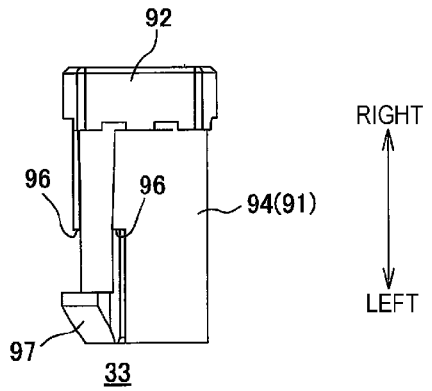
FIGS. 5A to 5D are a plan view, a right side view, a left side view, and a perspective view seen from the left rear side, which show a drum cleaning electrode shown in FIGS. 3A and 3B, respectively.
Figure 5B:
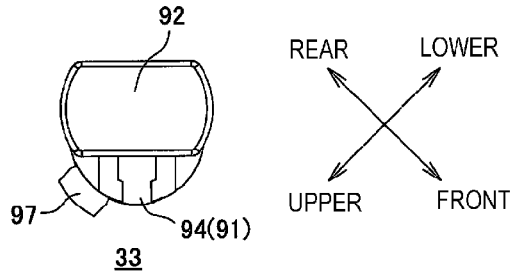
Figure 5C:
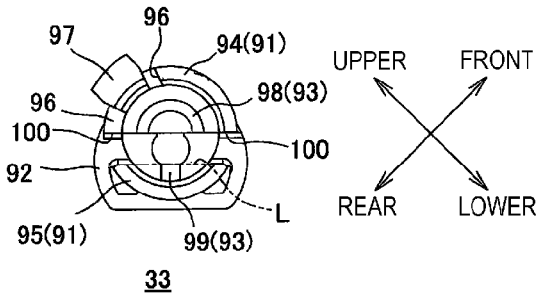
Figure 5D:
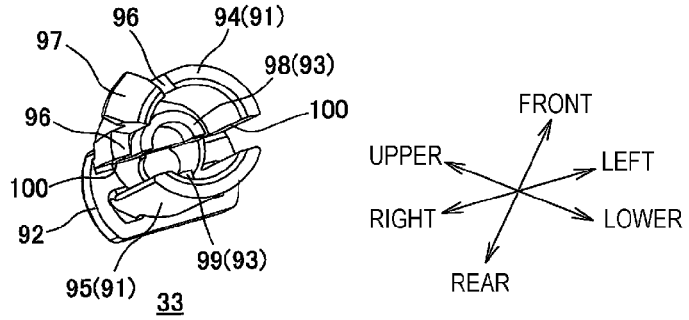

(7) Also, according to the drum cartridge 6, as shown in FIGS. 4A and 4B, the guide portions 77 and the roller-shaft abutting portion 73 are connected to each other.

Therefore, when the drum cleaning roller 10 abuts on the roller-shaft abutting portion 73, the guide portions 77 can be used to support the roller-shaft abutting portion 73.

As a result, when the drum cleaning roller 10 abuts on the roller-shaft abutting portion 73, the load of the drum cleaning roller 10 can be surely received by the roller-shaft abutting portion 73.

(8) Also, according to the drum cartridge 6, as shown in FIGS. 4A and 4B, the roller-shaft abutting portion 73 is provided along the facing direction of the photosensitive drum 8 and the drum cleaning roller 10.

Therefore, the drum cleaning electrode 33 can be moved along the roller-shaft abutting portion 73.

As a result, the roller-shaft abutting portion 73 can be disposed inside the electrode supporting hole 72 while the drum cleaning electrode 33 surely follow the drum cleaning roller 10.

(9) Also, according to the drum cartridge 6, as shown in FIGS. 4A and 4B, the roller-shaft abutting portion 73 may have the protruding portion 75 protruding toward the front upper side.

Therefore, it is possible to increase the contact area of the roller-shaft abutting portion 73 with the drum cleaning roller 10 by an amount corresponding to the protruding portion 75.

As a result, the load of the drum cleaning roller 10 can be surely received by the roller-shaft abutting portion 73.

(10) Also, according to the drum cartridge 6, as shown in FIGS. 4A and 4B, the thickness of the roller-shaft abutting portion 73 in the left-right direction is larger than the thickness of the roller-shaft abutting portion 73 in the direction connecting the front upper side and the rear lower side.

Therefore, the strength of the roller-shaft abutting portion 73 in the left-right direction can be secured.

As a result, the load of the drum cleaning roller 10 can be surely received by the roller-shaft abutting portion 73.

(11) Also, according to the drum cartridge 6, as shown in FIG. 6, the first abutting part 98 and the second abutting part 99 may be disposed at both sides with respect to the roller-shaft abutting portion 73 in the direction connecting the front upper side and the rear lower side.

Therefore, the drum cleaning electrode 33 can be surely brought into contact with the drum cleaning roller 10, using spaces on the front upper side and rear lower side of the roller-shaft abutting portion 73.

(12) Also, according to the drum cartridge 6, as shown in FIGS. 3A, 3B, and 7, the drum cleaning electrode 33 is disposed to overlap the drum cleaning roller 10 when the drum cleaning electrode 33 is projected in the left-right direction.

Therefore, when the drum cleaning electrode 33 is pressed against the drum cleaning roller 10 from the right side, the drum cleaning electrode 33 can be surely brought into contact with the right end surface of the drum cleaning roller 10.

Therefore, the drum cleaning electrode 33 and the drum cleaning roller 10 can be surely electrically connected.

8. Modifications

In the above described illustrative embodiment, the right flange member 48 of the photosensitive drum 8 is supported on the right side wall 37 through the right drum bearing 31R, and the left flange member 48 of the photosensitive drum 8 is supported on the left side wall 37 through the left drum bearing 31L.

However, the right flange member 48 of the photosensitive drum 8 may be supported directly on the right side wall 37, and the left flange member 48 of the photosensitive drum 8 may be supported directly on the left side wall 37.

In this case, the right side wall 37 functions as the first side wall, and the left side wall 37 functions as the second side wall.

Also, in the above described illustrative embodiment, as an example of the rotating body, the drum cleaning roller 10 is configured such that the drum cleaning electrode 33 supplies a bias to the drum cleaning roller 10 being in contact with the photosensitive drum 8. However, this configuration can be applied to various rotating bodies (for example, a transfer roller, a charging roller, a developing roller, and so on) capable of facing the photosensitive drum 8 and receiving a bias from the main body casing 2.

Also, in the above described illustrative embodiment, the electrode supporting hole 72 has a long hole shape long in the front-rear direction. However, the shape of the electrode supporting hole 72 is not particularly limited as long as the drum cleaning electrode 33 can be freely fit into the electrode supporting hole 72 in the front-rear direction. For example, the electrode supporting hole 72 may be formed in a substantially circular shape having a diameter larger than the length of the drum cleaning electrode 33 in the front-rear direction.

Also, in the above described embodiment, the process cartridge 5 is configured to be separated into the drum cartridge 6 having the photosensitive drum 8 and the developing cartridge 7 having the developing roller 11. However, the configuration of the process cartridge 5 is not limited to the configuration in which the drum cartridge 6 and the developing cartridge 7 can be separated. For example, the process cartridge 5 can be configured as a single unit such that a drum unit corresponding to the above described drum cartridge 6 and a developing unit corresponding to the above described developing cartridge 7 are formed integrally, that is, so as to be unable to be separated.

What is claimed is:

1. A photosensitive member cartridge comprising:

a photosensitive member;

a first side wall configured to rotatably support one end portion of the photosensitive member at one side in an axial direction of the photosensitive member;

a second side wall configured to rotatably support the other end portion of the photosensitive member at the other side in the axial direction of the photosensitive member;

a rotating body disposed between the first side wall and the second side wall to face the photosensitive member from a direction orthogonal to the axial direction; and a cartridge electrode extending in the axial direction and disposed on the first side wall to be movable in the axial direction, and configured to contact the rotating body to supply electric power input from an external part to the rotating body, wherein the cartridge electrode includes:

a first contact portion configured to contact an end surface of the rotating body at the one side in the axial direction; and a second contact portion disposed at an opposite side to the rotating body with respect to the first side wall in the axial direction, and configured to contact an electrode of the external part, and wherein the first side wall includes:

an opening portion penetrating through the first side wall in the axial direction, and in which the cartridge electrode is disposed; and an abutting portion disposed to overlap the opening portion in a direction orthogonal to the axial direction, and configured to abut the end surface of the rotating body, and wherein the cartridge electrode is configured such that the first contact portion is movable to the one side in the axial direction further than the abutting portion.

2. The photosensitive member cartridge according to claim 1, wherein at least a part of the abutting portion is disposed closer to an axis of the rotating body than the first contact portion, in a direction orthogonal to the axial direction.

3. The photosensitive member cartridge according to claim 1, wherein the rotating body is movable in the axial direction, and wherein a movable distance of the cartridge electrode in the axial direction is larger than a movable distance of the rotating body in the axial direction.

4. The photosensitive member cartridge according to claim 1, wherein the cartridge electrode includes a holding portion configured to rotatably hold the rotating body while contacting a circumferential surface of the rotating body.

5. The photosensitive member cartridge according to claim 4, wherein the rotating body is movable in a facing direction of the photosensitive member and the rotating body, and wherein the first side wall includes a supporting portion configured to support the cartridge electrode to be movable in the facing direction.

6. The photosensitive member cartridge according to claim 5, wherein the supporting portion includes an engaging portion protruding toward the rotating body and extending in the axial direction, and wherein the holding portion includes a groove-shaped engaged portion extending in the axial direction to be engaged with the engaging portion.

7. The photosensitive member cartridge according to claim 6, wherein the engaging portion and the abutting portion are connected with each other.

8. The photosensitive member cartridge according to claim 1, wherein the abutting portion is provided along a facing direction of the photosensitive member and the rotating body.

9. The photosensitive member cartridge according to claim 8, wherein the abutting portion includes a protruding portion protruding in an orthogonal direction orthogonal to the axial direction and the facing direction.

10. The photosensitive member cartridge according to claim 9, wherein a thickness of the abutting portion in the axial direction is larger than a thickness of the abutting portion in the orthogonal direction.

11. The photosensitive member cartridge according to claim 9, wherein the first contact portion is disposed at both sides with respect to the abutting portion in the orthogonal direction.

12. The photosensitive member cartridge according to claim 1, wherein the cartridge electrode is disposed to overlap the rotating body when the cartridge electrode is projected in the axial direction.

13. A photosensitive member cartridge comprising:

a photosensitive drum configured to rotate about a first axis;

a first drum supporting member configured to support an end portion of the photosensitive drum at one side in a direction along the first axis;

a second drum supporting member configured to support an end portion of the photosensitive drum at an opposite side to the one side in the direction along the first axis;

a rotating body disposed between the first drum supporting member and the second drum supporting member to face the photosensitive drum and configured to be rotatable about a second axis along the first axis; and a cartridge electrode configured to electrically connect with the rotating body, wherein the cartridge electrode includes:

a first contact portion configured to contact an end surface of the rotating body at one side in the direction along the first axis; and a second contact portion disposed at an opposite side to the rotating body with respect to the first drum supporting member, and configured to contact an electrode of an external part, wherein the first drum supporting member includes:

a hole penetrating the first drum supporting member in the direction along the first axis; and an abutting portion extending from a circumferential surface of the hole in a direction orthogonal to the direction along the first axis, and disposed outside the end surface of the rotating body in the direction along the first axis, wherein a part of the cartridge electrode is disposed within the hole, and wherein the rotating body is configured to be movable between a first position where the end surface abuts the abutting portion and a second position where the end surface is separated from the abutting portion and the end surface contacts the first contact portion, wherein the abutting portion is a plate-shaped member extending across the hole in the direction orthogonal to the direction along the first axis.

* * * * *